United States Patent [19]

Trötscher

[11] 4,154,004

[45] May 15, 1979

[54] APPARATUS FOR MONITORING THE DRAW-IN PROCEDURE AND THE TEARING-OFF OF SHEETS OF MATERIAL IN DRYERS, PARTICULARLY JET DRYERS

[75] Inventor: Gerhard Trötscher, Lindau, Fed. Rep. of Germany

[73] Assignee: Lindauer Dornier Gesellschaft mbH, Fed. Rep. of Germany

[21] Appl. No.: 826,138

[22] Filed: Aug. 19, 1977

[30] Foreign Application Priority Data

Oct. 16, 1976 [DE] Fed. Rep. of Germany ..... 2646814

[51] Int. Cl.[2] ..... F26B 13/12

[52] U.S. Cl. ..... 34/52; 34/54; 34/159; 226/11; 226/44; 226/45

[58] Field of Search ..... 34/49, 52, 54, 56, 203, 34/159, 207; 226/11, 44, 45

[56] References Cited

U.S. PATENT DOCUMENTS

| | | | |
|---|---|---|---|
| 1,543,368 | 6/1925 | Carrier | 34/52 |
| 2,501,537 | 3/1950 | Parkes | 34/159 |
| 2,928,185 | 3/1960 | Drew | 34/49 |
| 3,016,622 | 1/1962 | Gade et al. | 34/49 |
| 3,085,347 | 4/1963 | Justus | 34/49 |
| 3,326,436 | 6/1967 | Huck | 226/44 |
| 3,367,039 | 2/1968 | Jacobsen | 34/159 |
| 3,921,877 | 11/1975 | Gith | 226/45 |

FOREIGN PATENT DOCUMENTS

| | | | |
|---|---|---|---|
| 1312111 | 4/1973 | United Kingdom | 226/11 |

*Primary Examiner*—John J. Camby
*Assistant Examiner*—Larry I. Schwartz
*Attorney, Agent, or Firm*—James E. Bryan

[57] ABSTRACT

This invention relates to an improvement in an apparatus for monitoring the drawing-in operation and the tearing-off of a sheet of material in a dryer, wherein a sheet of material to be dried is guided over continuously-rotating screen-type conveyor belts, particularly jet dryers with conveyor belts positioned in several stages, and with means for transferring the sheet of material from one stage to the next-following stage, the improvement comprising a two-stage construction of the monitoring apparatus, a first stage comprising a first partial means for optically monitoring the path of the sheet of material during the drawing-in operation, and a second stage comprising a second partial means for monitoring the tension of the sheet of material in running operation, said first partial means releasing said second partial means upon completion of a malfunction-free drawing-in operation.

11 Claims, 2 Drawing Figures

Figure 1:
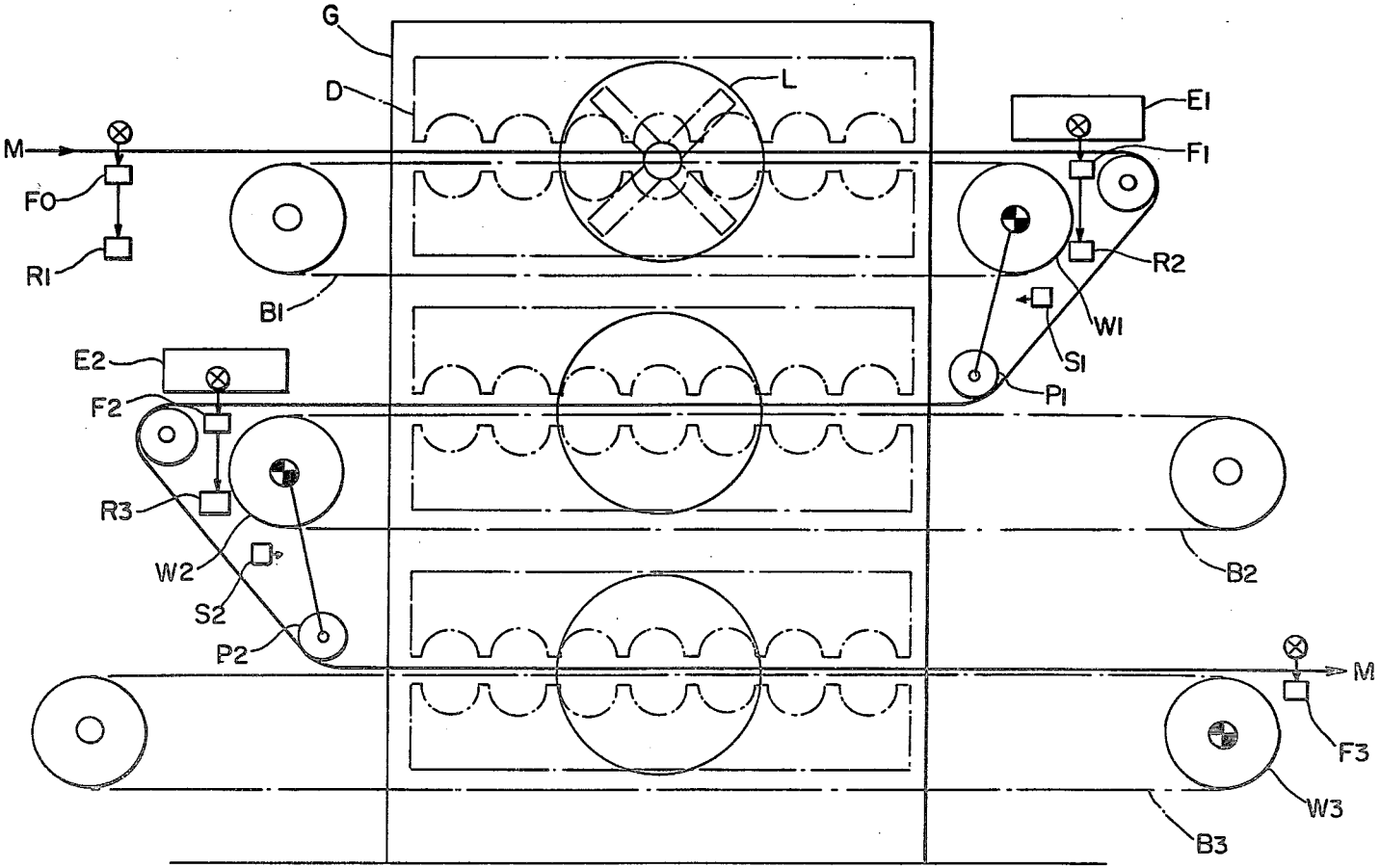

APPARATUS FOR MONITORING THE DRAW-IN PROCEDURE AND THE TEARING-OFF OF SHEETS OF MATERIAL IN DRYERS, PARTICULARLY JET DRYERS

The present invention relates to an apparatus for monitoring the draw-in procedure and the tearing-off of sheets of material in dryers, particularly jet dryers, in which a sheet of material to be dried, for example a sheet or web of paper, is guided over continuously rotating, screen-type conveyor belts. It is intended therein that the drawing-in procedure of the sheet of material and subsequently, during the operation thereof, any possible tearing-off of the sheet of material be monitored.

It is known in the art that planar materials, such as, for example, paper, cardboard, flowable substances, etc., are subjected, during the manufacturing processes thereof, to a drying process. Used for this purpose, according to a known process, are so-called drying cylinders which are heated and over which the sheet of material is guided. A different method has found wide acceptance in more recent times for reasons of cost, for technological and also economical reasons, especially in the manufacture of paper for the cellular board or corrugated paper industry. In this particular instance, the dryers are equipped with generally sieve-like conveyor belts for the material, and these conveyor belts rotate continuously in one, or in several stages. Warm drying air is blown onto the sheet of material carried by the conveyor belts, for example from slot-like jets or nozzles extending transversely to the direction of the sheet of material.

In dryers of this type, the introduction of the sheet of material generally involved difficulties because, depending upon the structural character of the tip of the narrow sheet of material, for example a sheet or web of paper, there existed the danger of a tearing-off thereof.

In order to render the feeding operation understandable in the case of a multiple-stage dryer, this procedure now will be initially described once more, as follows.

From the preceding so-called wet end, a narrow, wet strip of material, the so-called "tip", is fed to the dryer at full production speed. When no disturbance exists, this tip leaves the dryer after a specific period of time which depends upon the operating speed, and is then further conveyed to a cylinder after-drying group. As a result of the drying operation, the material shrinks, and the traction between the individual stages changes due to the material tension generated. The tractions generated at the individual stages are adjusted by means of potentiometers; the sheet or web of paper is thereafter run on the full width thereof, and thus the manufacturing and/or drying process proper is initiated.

The danger of a tearing-off of the sheet of material increases during the introducing process if the tractive force of the material between the machine aggregate ahead of the dryer, i.e. the wet end, and the first stage of the dryer, or also between the successive stages of the dryer, becomes too great. The disturbances caused thereby are very dangerous as, because of the relatively small distance of the sheet of material from the jets and the conveyor belts, and because of the air circulation brought about by the air-circulating ventilators, they lead to clogging and therefore may cause considerable damages to the jets, to the expensive and delicate conveyor belts, as well as to other parts at the interior of the dryer. Quite apart therefrom, such disturbances, if they arise, always involve downtime.

The aforementioned clogging and disturbances arise the more rapidly and are the more serious, the more rapidly the machine or the dryer runs in operation.

Inasmuch as tearing-in and/or tearing-off in the sheet of material cannot be prevented in principle in any dryer of the above-described construction comprising conveyor belts, the clogging produced thereby cannot be avoided either. It is, therefore, the object of the present invention to provide an apparatus for monitoring and controlling dryers of the construction mentioned hereinbefore which automatically detects any tearing-off and hence any possible disturbances, which controls the dryer, and initiates measures to prevent damage to the machine.

Starting from dryers in which a sheet of material to be dried is guided over continuously-rotating, screen-type conveyor belts, particularly in so-called jet or nozzle dryers having several stages, this object is achieved, in accordance with the present invention, by means of a two-stage construction of the monitoring apparatus, wherein the first stage comprises a first partial apparatus optically monitoring the path of the sheet of material during the pulling-in procedure, which partial apparatus — in case of the completed and disturbance-free pulling-in or feeding procedure or operation — releases a second partial apparatus which latter monitors the tension of the sheet of material during the running operation. A switch for switching on the second stage is blocked during the first stage and, after its release, is adapted to being actuated arbitrarily with simultaneous blocking of the first stage.

A further characteristic of the present invention is that the first partial apparatus comprises optical sensors for monitoring the introduction and the exit of the material sheet tip into and out of each stage, and that further provided therein are time members which are adapted to be switched on at the inlet and which, upon the expiration of the time period predetermined for these time members, prepare a switching network or control circuit for the dryers, indicating a disturbance.

In the case of an untimely exit of the material sheet tip, or in the case of an interruption of the sheet of material, the switching network or control circuit may be effectively switched by means of the optical sensor at the exit. The time members advantageously have a running time corresponding to the passage time of the material sheet tip from the optical sensing means or sensor at the inlet to the sensing means or sensor at the exit.

Figure 2:
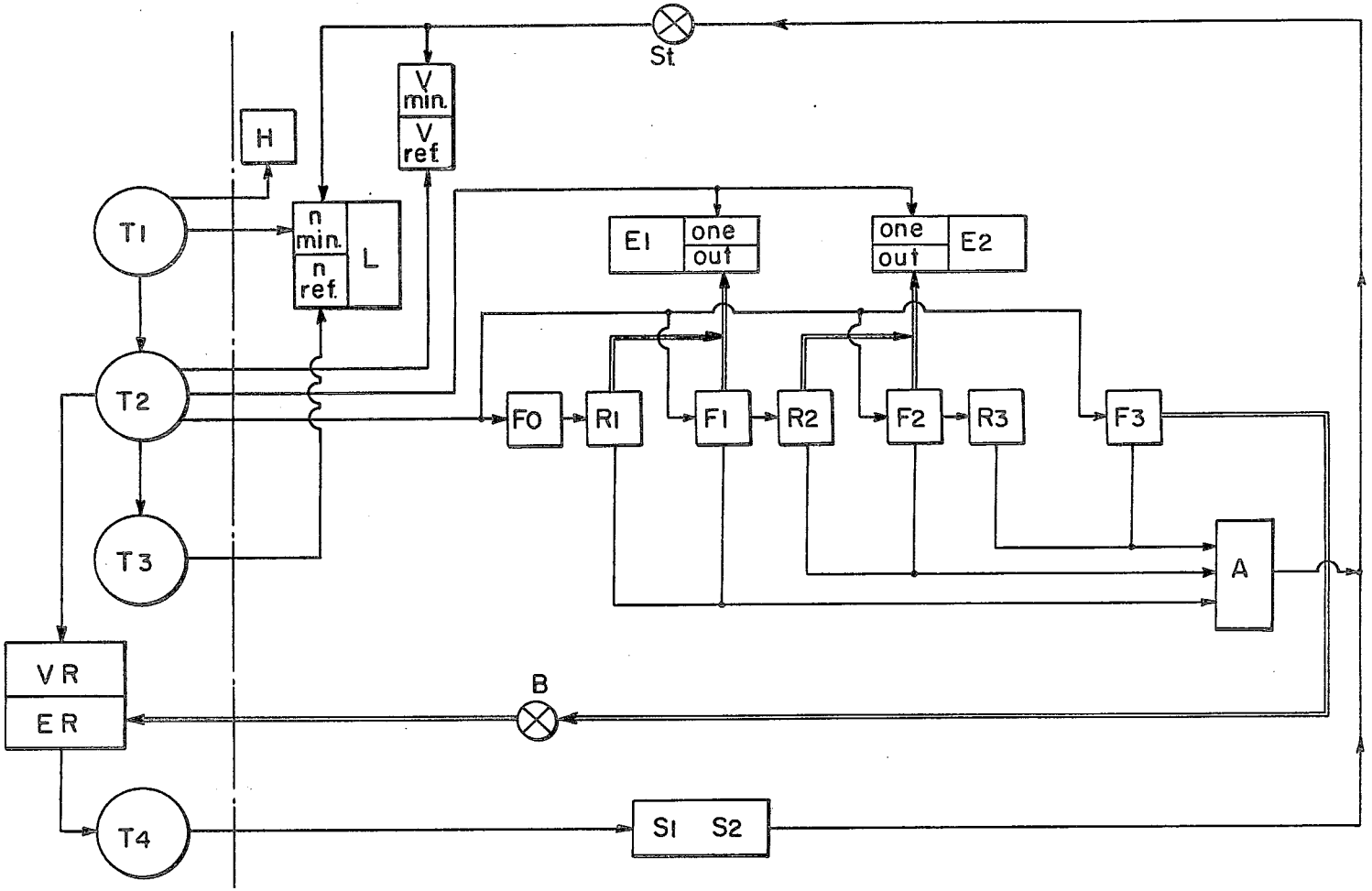

One embodiment of the present invention now will be further illustrated by reference to the accompanying drawings, wherein FIG. 1 schematically illustrates a jet dryer with three stages, and FIG. 2 illustrates in a block diagram the operating sequence of the monitoring process.

As is apparent from FIG. 1, a sheet of material M is conveyed to the dryer from the left-hand side in the direction of the arrow from a preceding, so-called wet end (not further illustrated herein). Conceived here as an example of a sheet of material is a sheet or web of paper. The sheet or web of paper arrives initially on a continuously-rotating, screen-type conveyor belt B1 in a first stage. The conveyor belt B1 is shown in dash-dotted lines. It is driven by the roll W1 illustrated on the right-hand side. The drive of this roll is indicated in the center of the roll by the black-and-white sectors. The free-wheeling reversing roll of the conveyor belt B1 on the left-hand machine side is not shown in detail. The two drive and reversing rolls of the conveyor belt B1 are positioned outside of a dryer housing G. Within the housing, jet or nozzle casings D are shown in dash-dotted lines. The sheet or web of paper M is guided on the screen-type conveyor belt B1 between two jet or nozzle boxes or casings, at which time dry air is blown from the jets or nozzles onto the sheet or web of paper. For air circulation, a ventilator L is provided within the dryer. Not shown in FIG. 1 are heating means for heating the dry air.

Provided in a central stage of the dryer is a second wire screen B2. Its contruction is analogous to the above-described wire screen B1. The drive roll of the screen B2 is indicated by W2. Finally provided in the dryer is a third stage with a wire screen B3 and its drive roller W3.

For transition from one stage to the next, transfer means are provided. The construction of these transfer means is known and is not a part of the present invention. The transfer means are therefore not described herein in any detail. They are composed of a reversing roller (not further designated herein) behind the drive roller of the respective stage, and a transfer means which is designated with reference symbol E1, for example, in the first stage. This transfer means E1 lifts the material sheet or web of paper M off of the drive roller W1 and transfers the sheet to the reversing roller from whence it then will fall onto the belt B2 of the underlying stage, and there will be further transported in the conventional fashion. In an analogous manner, a transfer means E2 also is provided at the transition from the central stage with the belt B2 to the third stage with the belt B3. The transfer means E1 and E2 are switched on only for the transfer process itself and are immediately switched off again as soon as the sheet or web of paper M has faultlessly arrived at the next stage.

It is further shown on the basis of the example of the first stage that the drive roll or roller W1 of the belt B1 is equipped with a pendulum roll P1. This pendulum roll or roller P1 is displaced due to the traction of the sheet or web of paper M in the direction of movement of this sheet or web. Accordingly, the pendulum roll or roller P1 normally assumes a position deviating from the vertical direction. In case of a tearing-off of the sheet or web of paper, the tractive force of the sheet or web of paper M is eliminated, and the pendulum roll or roller P1 returns to the vertical position. At that time it actuates a limit switch S1 whose function will be further described hereinbelow. A corresponding pendulum roll or roller P2 also is positioned at the drive roll or roller W2 of the second stage. A limit switch also is provided there and is identified with reference symbol S2.

Positioned at the entrance of the web of paper M into the uppermost stage, i.e. before the beginning of the belt B1, is an optical sensor including a light source and a photoelectric cell F0. Connected with the photoelectric cell of the sensor is a time member R1. In an analogous manner, an optical sensor F1 is also positioned at the exit of this stage, i.e. at the end of the conveying device B1. Its light source is here integrated in the transfer means E1. Connected to the coordinated photoelectric cell F1 is again a time member R2. Such optical sensors are provided at the inlet and outlet of each stage. Advantageously, the sensors at the outlet of one stage are combined with the sensors at the inlet of the next-following stage. Hence, there results a saving and a significant simplification. A corresponding sensor arrangement is provided at the transition from the belt B2 to the belt B3. This sensor is composed of the light source built into the transfer means E2, of the coordinated photoelectric cell F2, and of the connected time member R3. Finally provided at the exit of the third stage behind the drive roll or roller W3 is another optical sensor whose photoelectric cell is designated with reference symbol F3. At that sensor, however, an additional time member is not required.

The construction of a dryer having thus been described hereinabove in its essential features, the operation of the present invention now will be explained hereinafter in further detail with reference to FIG. 2. Illustrated in the block diagram of FIG. 2, to the left of the boldly dash-dotted line, are essentially the elements of the device which are to be actuated manually, whereas to the right of the line there are shown the elements switched into the automatic sequence of the drawing-in operation for the web of paper M and for the later monitoring of any tearing-off during the running operation.

The drawing-in procedure will be initially described in a simplified form, and mentioned in this connection are the monitoring steps that take place automatically. In order to set the dryer in operation, the key T1 is depressed first. As a result, and preparatorily, a heating device H for the dry air is switched on. Simultaneously therewith and preparatorily, the ventilator L is switched on at a minimum speed of $n_{min}$. Actuated thereafter is the key T2 "feed in". As a result thereof, the conveyor belts B1, B2, and B3 shown in FIG. 1 are switched on at the operating speed of $v_{ref}$. Also switched on are the transfer means E1 and E2. The key T2 "feed in" is mechanically or electrically locked with respect to the key T4 "operation". The locking condition is indicated by the rectangular block VR. After the actuation of the key T2 "feed in", a narrow web of paper M coming from the wet end is conveyed to the dryer. Furthermore, the monitoring functions in the dryer are initiated, and the preliminary run of the paper tip is pursued.

By means of the key T2, also the optical sensors F0, F1, F2, and F3 which are important for the monitoring operation are switched on. Coupled with the first sensor F0 is a time member R1. The running time of this time member R1 corresponds to the transporting time of the web of paper through one stage at the normal operating speed $v_{ref}$. If desired, the running time of this time member also may be slightly longer than the aforementioned transporting time of the web of paper through one stage. The sensor F0 acknowledges the entrance of the tip of the web of paper into the first stage, whereas the sensor F1 monitors the exit thereof from the respective stage. When, at the entrance, the light ray at the sensor F0 is interrupted by the advancing paper web tip, the time member R1 is switched on in known manner which therefore is not further described herein. When the tip of the web of paper reaches, at the exit of the stage, the sensor F1, there too the light ray will be interrupted, and F1 acknowledges therewith the arrival at the exit of the paper web tip. When the tip of the web of paper reaches the sensor F1 on time, the time member R1 has not run out of its time yet, and in this condition the sensor F1 and the time member R1 both act together in such a manner that, as indicated by thin double lines and arrows, the transfer means E1 is switched off because, not only has the sheet or web been conveyed faultlessly through the stage, but the transfer operation also has been found to have been completed. The tip of the web of paper will then continue to run on the underlying conveyor belt B2. The above-mentioned sensor F1 is simultaneously the inlet sensor for the conveyor belt B2. At the instant when its light ray is interrupted by the pushed-forward tip of the web of paper, the sensor F1 switches on its coordinated time member R2. The tip of the web of paper now continues to run on the lower conveyor belt B2 until its exit from the dryer. The arrival of the tip of the web of paper at the exit of this stage is monitored by the sensor F2 positioned there. In the normal case, i.e. when the tip of the web of paper arrives there on time, the time member R2 has not run out as yet, and the sensor F2 and the time member R2 act together in the manner already described hereinabove, i.e. in such a way that the transfer means E2 also is switched off again. This process has been indicated here again with thin double lines and arrows. The tip of the web of paper travels from there to the conveyor belt B3 of the third stage, at the exit of which the sensor F3 is positioned. When the tip of the web of paper reaches the sensor F3, the drawing-in process is completed, and the entire installation can be switched to normal operation. The double lines and arrows emanating from the sensor F3 indicate that a monitoring lamp B is switched on which indicates the successful end of the drawing-in or feeding procedure and informs the operating personnel of the fact that from then on running can be performed at normal operating conditions. It is further shown by the extended double line that not only an optical indication is effected, but that at the same time also the aforementioned locking between the keys T2 and T4 can be released. This automatic release or unlocking is shown in a simplified manner by ER. What is involved here is a known construction, and for this reason there is no need for a further discussion of the locking or unlocking of keys. The key T4 "operation" is thus freed for actuation by the the operating personnel.

The drawing-in or feeding procedure for the web of paper is therewith completed. The web of paper now can be run to full width. Thereby the paper tractions are controlled or adjusted. Due to the actuation of the key T4, also — as shown in FIG. 2 — the two limit switches S1 and S2 of the pendulum rolls or rollers P1 and P2 of FIG. 1 are switched on. As a result thereof, what is set in operation in place of the monitoring of the drawing-in or feeding operation is the monitoring of any tearing-off for the full web of paper. If the web of paper tears in the full width thereof, one of the pendulum rolls or rollers P1 or P2 swings back into the vertical position and actuates the coordinated limit switch S1 or S2. As shown by the block diagram of FIG. 2, switched on by the limit switches S1 or S2 is an optical trouble-indicating means, for example a lamp St, and in addition thereto, the entire installation is switched on "disturbance", i.e. the ventilators L are operated at a minimum rate of revolutions $n_{min}$ and the conveyor belts are operated at the minimum speed $v_{min}$. Due to the reduction of the drive speed for the conveyor belts to a minimum crawling speed, a clogging of the dryer is avoided with certainty.

In order to prevent, or at least reduce, during the feeding process, the disturbing influence of the air currents, which are caused by the circulating air ventilators, on the tip of the sheet of material or web of paper, the amount of air which circulates inside the dryer must be automatically throttled. A complete switching-off of the ventilator blowers is impossible because, in that case, the tip of the sheet would leave the dryer while still too wet. For the case of a direct gas heating for the dryer, this deficiency would be very grave because gas heating automatons which supervise the setting in operation of the burners release the ignition of these burners only after approximately 5 to 7 minutes. Within this period of time, however, the temperature level has decreased to such an extent that, in addition to the aforementioned waiting period, that time interval must be added which is required to once again attain the desired temperatures within the dryer.

In order to eliminate the problem of the disturbing influences exerted by the circulating air in the dryer which, according to experience, equally lead to disturbances of the type mentioned above, ventilator motors are used which are preferably pole-reversible motors which, when the dryer is put in operation (key T1 depressed), operate at a low speed (for example at 700 revolutions/minute). After the switching-on of the drawing-in action, (key T2 depressed), the operator has the possibility of additionally switching on the higher speed (for example 1400 revolutions/minute) of the ventilator motors at any desired point in time, advantageously only after the tip of the sheet of material has been pulled in completely and the operating-readiness lamp B lights up. The switching-on of the higher operating speed for the ventilator motors L is effected by means of the key T3.

Reference will now be made once more to the pulling-in procedure. This procedure has been described hereinabove for a faultless running thereof. Assumed now is a disturbance as a result of which the tip of the sheet of material M will not arrive at the exit of a stage within the predetermined period of time, i.e. within the running time of the time members. This eventuality will be explained for the example of the first stage with the belt B1. By means of the tip of the sheet of material running in, the sensor F0 is influenced, and the time member R1 is switched on. If now, due to the assumed disturbance, the tip of the sheet of material does not arrive at the exit in time, i.e. if the sensor F1 there located does not timely acknowledge the arrival of the tip, the time member R1 has run out. In view of the condition prevailing at that time, the sensor F1 and the time member R1 act differently than has been mentioned above. The coaction thereof in the case of a disturbance is shown by single lines and arrows. R1 and F1 excite, in this case, a switching and control circuit A. From this switching and control circuit A, a trouble-indicating means St is switched on — as is also shown by thin lines and arrows —, and the transporting or conveying speed of the belts is reduced to a crawling speed. This speed reduction is indicated by the block $v_{min}$. As a result of the reduction of the transporting or conveying speed to a crawling speed, it is possible to stop a possibly threatening clogging of the machine already at the very outset, to retain the inevitable material accummulation very small, and to pull it manually out of the dryer. At the same time, also the ventilator motors L are switched back to the low speed $n_{min}$. The effects of a disturbance are, accordingly, the same as those of a disturbance in the running operation mentioned above.

Once the disturbance has been recognized and obviated, the pulling-in procedure begins anew. Therefore, the key T2 "feed in" is initially depressed, whereupon the conveyor belts will switch back to the original speed $v_{ref}$. The optical sensors together with the time members once again assume their function, and the transfer means are ready for operation.

By virtue of the present invention, in which the monitoring apparatus is provided in two stages, namely in a first stage which monitors the pull-in or feeding procedure, and in a second stage which assumes the task of monitoring during the running operation, the consequences of inevitable disturbances are reduced to a minimum. The entire monitoring installation is simple in its construction and very easy to survey. It is composed entirely of individual elements which in their action are known.

It will be obvious to those skilled in the art that many modifications may be made within the scope of the present invention without departing from the spirit thereof, and the invention includes all such modifications.

What is claimed is:

1. In an apparatus for monitoring the drawing-in operation and the tearing-off of a sheet of material in a dryer, wherein a sheet of material to be dried is guided over continuously-rotating screen-type conveyor belts, particularly jet dryers with conveyor belts positioned in several stages, and with means for transferring the sheet of material from one stage to the next-following stage, the improvement comprising a two-stage construction of the monitoring apparatus, a first stage comprising a first partial means for optically monitoring the path of the sheet of material during the drawing-in operation, and a second stage comprising a second partial means for monitoring the tension of the sheet of material in running operation, said first partial means releasing said second partial means upon completion of a malfunction-free drawing-in operation.

2. An apparatus according to claim 1 including switch means for locking the second stage during operation of the first stage and, after release, actuatable at will with simultaneous locking of the first stage.

3. An apparatus according to claim 1 in which said first partial means includes optical sensor means for monitoring the inlet and outlet of a tip of the sheet of material into and out of each stage, and time member means adapted to be switched on during the drawing-in operation, said time member means, after the expiration of a predetermined running time, preparing a switching network means, indicating a malfunction, for the dryer.

4. An apparatus according to claim 3 in which said switching network means is adapted to be switched, in case of an untimely exit of the tip of the sheet of material or in case of an interruption of the sheet of material, by optical sensor means at the outlet of the apparatus.

5. An apparatus according to claim 4 in which said time member means have an operating time corresponding to the passage time of the tip of the sheet of material from the optical sensor means at the inlet to the optical sensor means at the outlet at a predetermined speed of the conveyor belts.

6. An apparatus according to claim 3 in which said time member means are switchable by the optical sensor means for monitoring the inlet.

7. An apparatus according to claim 3 in which the optical sensor means for the outlet are combined with the optical sensor means at the inlet to the next-following stage.

8. An apparatus according to claim 3 in which, in case of an orderly drawing-in operation, the transfer means are adapted to be switched-off by the optical sensor means monitoring the inlet into the next-following stage.

9. An apparatus according to claim 1 including, in said second stage, pendulum rollers equipped with limit switch means for monitoring the traction of the sheet of material.

10. An apparatus according to claim 3 including means in said switching network means for reducing the conveying speed of the dryer in case of a malfunction.

11. An apparatus according to claim 3 including means in said switching network means for reducing the speed of dryer blowers in case of a malfunction.

* * * * *